US011060234B2

(12) United States Patent
Lee et al.

(10) Patent No.: US 11,060,234 B2
(45) Date of Patent: Jul. 13, 2021

(54) APPARATUS FOR TREATING LAUNDRY

(71) Applicant: LG Electronics Inc., Seoul (KR)

(72) Inventors: Jongsung Lee, Seoul (KR); Taewoo Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 709 days.

(21) Appl. No.: 15/886,304

(22) Filed: Feb. 1, 2018

(65) Prior Publication Data

US 2018/0216282 A1 Aug. 2, 2018

(30) Foreign Application Priority Data

Feb. 2, 2017 (KR) ..... 10-2017-0014838

(51) Int. Cl.

| | |
|---|---|
| ***D06F 39/14*** | (2006.01) |
| ***D06F 23/04*** | (2006.01) |
| ***D06F 37/28*** | (2006.01) |
| ***D06F 33/00*** | (2020.01) |

(52) U.S. Cl.

CPC ..... *D06F 39/14* (2013.01); *D06F 23/04* (2013.01); *D06F 33/00* (2013.01); *D06F 37/28* (2013.01)

(58) Field of Classification Search

None

See application file for complete search history.

(56) References Cited

U.S. PATENT DOCUMENTS

2009/0064725 A1 3/2009 Lim et al.

FOREIGN PATENT DOCUMENTS

| | | |
|---|---|---|
| EP | 2682512 | 1/2014 |
| EP | 2868795 | 5/2015 |

OTHER PUBLICATIONS

European Extended Search Report in European Application No. 18154310.9, dated Jun. 7 2018, 9 pages.

*Primary Examiner* — Rita P Adhlakha

(74) *Attorney, Agent, or Firm* — Fish & Richardson P.C.

(57) ABSTRACT

Disclosed is a laundry treating apparatus. The present invention includes a cabinet having an opening, a laundry receiving part provided within the cabinet to receive the laundry therein, the laundry receiving part having an input entrance communicating with the opening, a door opening/closing the opening, and a hinge part joining the door to the cabinet rotatably, the hinge part including a base joined to the cabinet, a projection portion projected from the base to be connected to the door, a hinge holder joined to the door to support one side of the projection portion rotatably, and a hinge cover joined to the hinge holder to support the other side of the projection portion rotatably, wherein the hinge holder further includes a reinforce recess having one side formed concave. And, the hinge holder is characterized in being formed in uniform thickness.

16 Claims, 9 Drawing Sheets

FIG. 5A
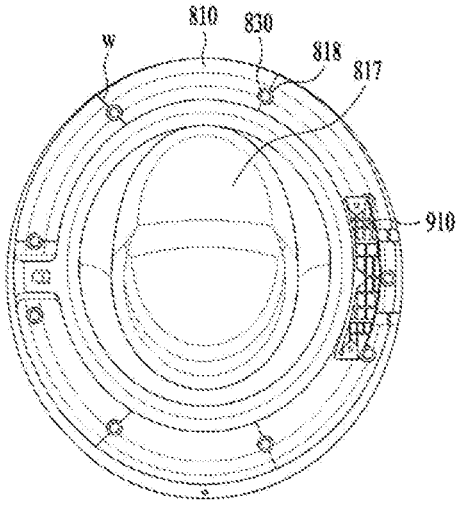
FIG. 5B
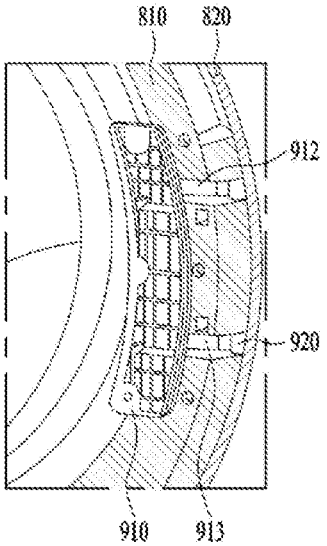
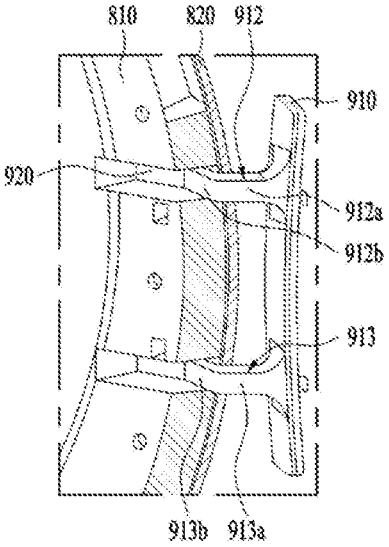
FIG. 5C
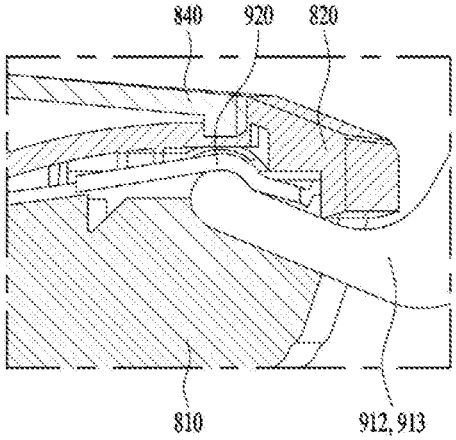
FIG. 5D

APPARATUS FOR TREATING LAUNDRY

CROSS-REFERENCE TO RELATED APPLICATION

Pursuant to 35 U.S.C. § 119(a), this application claims the benefit of earlier filing date and right of priority to Korean Application No. 10-2017-0014838, filed on Feb. 2, 2017, the contents of which are hereby incorporated by reference herein in their entirety.

BACKGROUND OF THE INVENTION

Field of the Invention

The present invention relates to an apparatus for treating laundry.

Discussion of the Related Art

Generally, a laundry treating device includes a device for washing laundry, a device for drying laundry, or a device capable of washing and drying laundry. In a laundry treating device, laundry washing corresponds to a cycle of removing particles attached to laundry through actions of water and detergent and laundry drying corresponds to a cycle of dehydrating laundry through a hot air supplier provided to the laundry treating device.

Generally, a laundry treating device includes a cabinet having an opening by forming an exterior, a laundry receiving part provided within a cabinet, a driving unit rotating a drum configuring the laundry receiving part, and a door configured to open/close the opening.

As the door of the laundry treating device occupies a considerable area of one side of the cabinet, a configuration of the door considerably affects overall aesthetic view and unity.

Since the door is configured to be turned centering on a front or top of the cabinet of the laundry treating device, user's eyes may be focused on the door.

Recently, using such property of the door, a laundry treating device is manufactured in a manner that a control panel configured to display a state of the laundry receiving part and/or receive an input of a control command for controlling the laundry receiving part to perform a washing or drying cycle.

In order to reinforce user's accessibility and emphasize aesthetic impression, the door may be configured to have a diameter greater than that of the opening.

Hence, the door can play a role as an interface of enabling a user to control and recognize the laundry treating device as well as open/close the opening.

However, since a control panel should be installed within the above-mentioned laundry treating device, the door needs to be configured by joining various components together.

Namely, the door consists of an inner frame for opening/closing the opening and an outer frame forming a front side of the door by being joined to the inner frame, and the control panel can be inserted and installed between the inner frame and the outer frame.

According to the related art laundry treating device, since the outer frame and the inner frame form the exterior of the door together, there is a problem that the unity of the door is degraded.

If the outer frame and the inner frame are joined to each other by a fastening member such as a bolt, a nut and the like, the fastening member and the fastening part are externally exposed. Hence, there is a problem that the aesthetic impression is degraded.

Since a weld line is formed on the fastening part joined to the fastening member in the course of injection molding of the exterior of the door, there is a problem that the overall unity is reduced.

And, there is also a problem that a user mistakes the weld line for a crack in the door.

As the control panel is installed in the door, a diameter of the door increases. Hence, when the opening is opened or closed, it is necessary to turn the door at a wider angle. In doing so, as the inner and outer frames of the door collide with a hinge part coupling the door with the cabinet rotatably, they may be broken.

Generally, the hinge part is provided in a manner of being inserted between the inner and outer frames of the door. Here, thickness of the hinge part may differ for each portion for rigidity.

If the thickness of the hinge part differs, it is advantageous to maintain the rigidity of the hinge part. Yet, it causes a problem that the thickness of the door increases.

And, it also causes a problem that material and molding costs are raised in manufacturing the hinge part.

SUMMARY OF THE INVENTION

Accordingly, embodiments of the present invention are directed to a laundry treating apparatus that substantially obviates one or more problems due to limitations and disadvantages of the related art.

One object of the present invention is to provide a laundry treating apparatus, by which a production cost of a hinge holder can be reduced in a manner that the hinge holder has uniform thickness.

Another object of the present invention is to provide a laundry treating apparatus, by which a hinge holder can maintain the same rigidity and durability of an existing hinge holder despite having relatively small thickness.

Another object of the present invention is to provide a laundry treating apparatus, by which a defect rate in producing and molding a hinge holder can be lowered.

Another object of the present invention is to provide a laundry treating apparatus, by which thickness of a door can be reduced.

Further object of the present invention is to provide a laundry treating apparatus, by which an excessive rotation of a door and a breakage of the turned door can be prevented.

Technical tasks obtainable from the present invention are non-limited by the above-mentioned technical tasks. And, other unmentioned technical tasks can be clearly understood from the following description by those having ordinary skill in the technical field to which the present invention pertains.

Additional advantages, objects, and features of the invention will be set forth in the disclosure herein as well as the accompanying drawings. Such aspects may also be appreciated by those skilled in the art based on the disclosure herein.

To achieve these objects and other advantages and in accordance with the purpose of the invention, as embodied and broadly described herein, an apparatus for treating laundry according to one embodiment of the present invention includes a cabinet having an opening, a laundry receiving part provided within the cabinet to receive the laundry therein, the laundry receiving part having an input entrance communicating with the opening, a door opening/closing the opening, and a hinge part joining the door to the cabinet rotatably, the hinge part including a base joined to the cabinet, a projection portion projected from the base to be connected to the door, a hinge holder joined to the door to support one side of the projection portion rotatably, and a hinge cover joined to the hinge holder to support the other side of the projection portion rotatably, wherein the hinge holder further comprises a reinforce recess having one side formed concave.

Preferably, the projection portion may include a shaft extending from an end to form a rotation shaft of the door and the hinge holder may further include a holder body in a plate shape having the reinforce recess and a shaft receiving recess provided to both sides or one side of the reinforce recess to receive the shaft therein in a manner that one side of the holder body is formed concave.

More preferably, the reinforce recess and the shat receiving recess may be projected from one side of the holder body in a same direction.

More preferably, the projection portion may include a first projection portion projected from the base by including a first shaft provided to an end in a manner of extending to form a rotation shaft of the door and a second projection portion projected from the base by being spaced apart from the first projection portion in a predetermined distance and including a second shaft provided to an end in parallel with the first shaft and the hinge holder may include a first shaft receiving recess having at least one portion of the first shaft received therein and a second shaft receiving recess having at least one portion of the second shaft received therein by being spaced apart from the first shaft receiving recess in a predetermined distance.

Here, the reinforce recess may be provided between the first and second shaft receiving recesses of the holder body.

A depth of each of the first and second shaft receiving recesses may be set different from that of the reinforce recess.

The first projection portion may include a first projection rib projected from the base toward the door and a first receiving rib extending from the first projection rib in a direction getting away from the opening by having the first shaft provided to an end, the second projection portion may include a second projection rib projected from the base toward the door and a second receiving rib extending from the second projection rib in a direction getting away from the opening by having the second shaft provided to an end, and the hinge holder may include a first receiving rib receiving recess provided to one side of the first shaft receiving recess so as to receive at least one portion of the first receiving rib therein and a second receiving rib receiving recess provided to one side of the second shaft receiving portion so as to receive at least one portion of the second receiving rib therein.

A depth of each of the first and second receiving rib receiving recesses may be set different from that of the reinforce recess.

The reinforce recess may include a center recess provided between the first and second shaft receiving recesses, a first extension recess extending from one side of the center recess toward the first receiving rib recess, and a second extension recess extending from the other side of the center recess toward the second receiving rib recess.

The center recess may further extend from an overlapping portion between the first and second extension recesses in one direction and each of the first and second extension recesses may further extend from a portion overlapping with the center recess in the other direction.

The hinge holder may include a flange extending from an outer circumference of the holder body and the flange may be bent in a direction opposite to a depth direction of the reinforce recess.

The flange may include a center flange provided to a portion facing the opening in an outer circumference of the holder body by extending by a gap between the first and second receiving rib receiving recesses, a first extension flange extending to one end of the holder body by being spaced apart from the center flange by a thickness of the first receiving rib receiving recess, a second extension flange extending to the other end of the holder body by being spaced apart from the center flange by a thickness of the second receiving rib receiving recess; a top flange provided to one side of the outer circumference of the holder body in a direction vertical to a direction facing the opening, and a bottom flange provided to the other side.

More preferably, the projection portion may include a projection rib projected from the base toward the door and a receiving rib extending from the projection rib in a direction getting away from the opening by having the shaft provided to an end and the hinge holder may include a stop portion for limiting a rotation angle of the receiving rib.

Here, the stop portion may include a support portion projected in an opposite direction of the shaft receiving recess so as to come into contact with the receiving rib.

The stop portion may further include a rigid bending portion projected from both lateral sides of the support portion in a direction of the shaft receiving recess.

And, the receiving rib may include a block portion provided to one side to come into contract with the stop portion.

Accordingly, the present invention provides the following effects and/or features.

First of all, the present invention provides a laundry treating apparatus, by which a production cost of a hinge holder can be reduced in a manner that the hinge holder has uniform thickness.

The present invention provides a laundry treating apparatus, by which a hinge holder can maintain the same rigidity and durability of an existing hinge holder despite having relatively small thickness.

The present invention provides a laundry treating apparatus, by which a defect rate in producing and molding a hinge holder can be lowered.

The present invention provides a laundry treating apparatus, by which thickness of a door can be reduced.

And, the present invention provides a laundry treating apparatus, by which an excessive rotation of a door and a breakage of the turned door can be prevented.

Effects obtainable from the present invention may be non-limited by the above mentioned effect. And, other unmentioned effects can be clearly understood from the following description by those having ordinary skill in the technical field to which the present invention pertains.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings, which are given by illustration only, and thus are not limitative of the present invention, and wherein:

FIGS. 5A through 5D are diagrams showing a door of a laundry treating apparatus according to one embodiment of the present invention;

DETAILED DESCRIPTION OF THE INVENTION

Reference will now be made in detail to a laundry treating apparatus according to an embodiment of the present invention, examples of which are illustrated in the accompanying drawings. A singular representation may include a plural representation unless it represents a definitely different meaning from the context. For the sake of brief description with reference to the drawings, the same or equivalent components may be provided with the same reference numbers, and description thereof will not be repeated. In the present disclosure, that which is well-known to one of ordinary skill in the relevant art has generally been omitted for the sake of brevity.

The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

Figure 1:
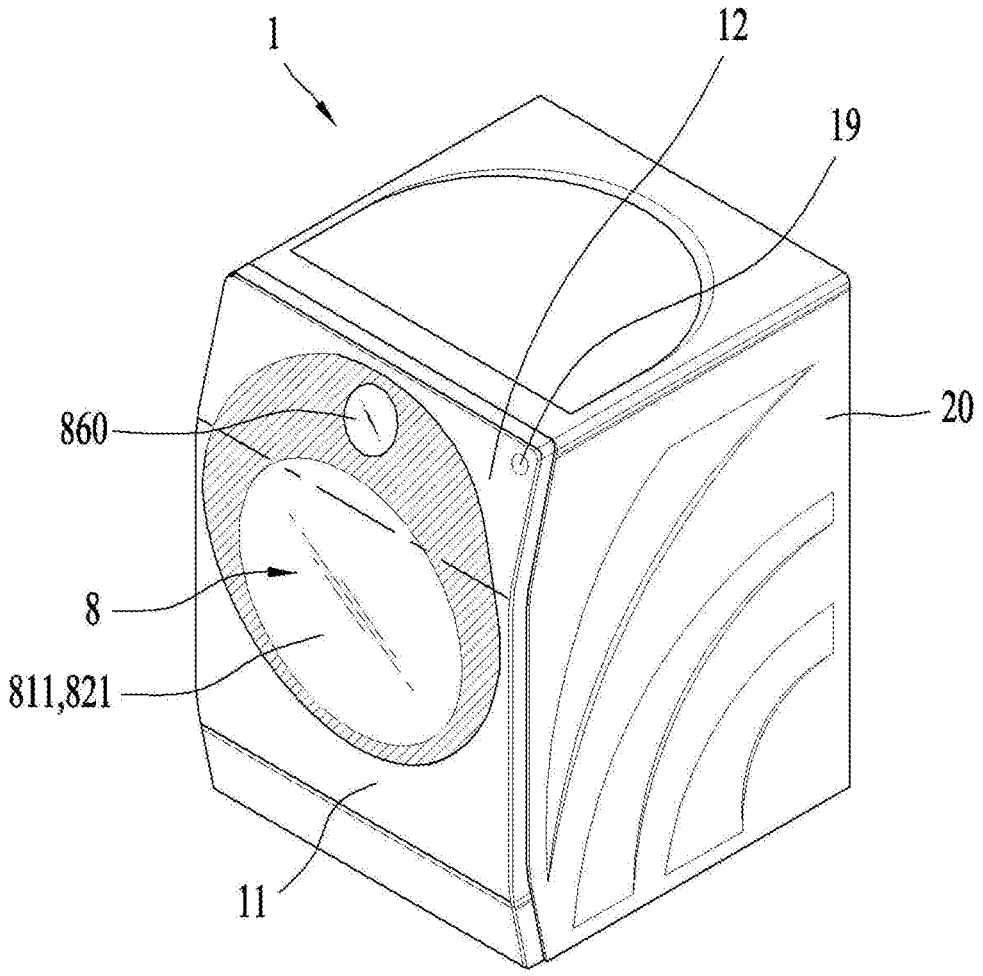
FIG. 1 is a diagram showing an exterior of a laundry treating apparatus according to the present invention.
Figure 2:
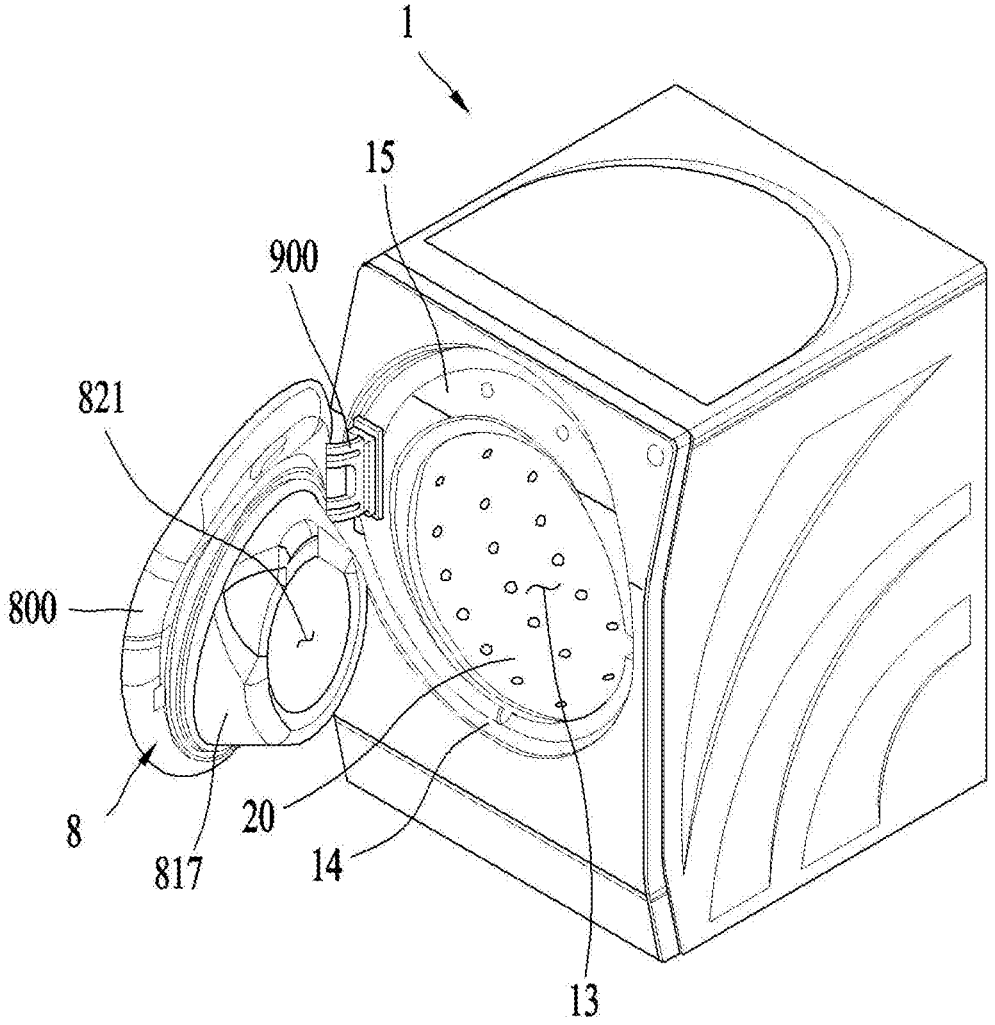
FIG. 2 is a diagram showing a structure that a door of a cabinet is open in a laundry treating apparatus according to the present invention.

FIG. 1 is a perspective diagram showing an exterior of a laundry treating apparatus according to the present invention. FIG. 2 is a diagram conceptually showing a state that an opening is open by turning a door.

Referring to FIG. 1 and FIG. 2, a laundry treating apparatus includes a cabinet 1 and a door 8.

The cabinet 1 forms an exterior and has an opening 13 through which laundry is inputted. Although FIG. 1 and FIG. 2 show that the opening 13 is provided to a front side of the cabinet 1 having a hexahedral shape, they are provided for description only. Alternatively, the opening 13 may be provided to a top side of the cabinet 1.

The cabinet 1 of the laundry treating apparatus according to one embodiment of the present invention may include a front panel 10 having the opening 13 provided to a front side thereof. A laundry receiving part 20 configured to receive laundry therein may be provided within the cabinet 1 by having an input entrance communicating with the opening 13.

If the laundry treating apparatus of the present invention is configured as a device for drying laundry, the laundry receiving part may include a drum 22 rotatably provided within the cabinet 1.

If the laundry treating apparatus of the present invention is configured as a device capable of both laundry washing and laundry drying, the laundry receiving part may include a tub 21 provided within the cabinet to store water therein and a drum 22 rotatably provided within the tub to receive laundry therein.

A drive unit (not shown) configured to rotate the drum 22 may be provided to one side of the tub 21 or within the cabinet 1. The drive unit may include a motor generating a drive force and a belt rotating the drum 22 using the drive force. The drive unit (not shown) includes a stator provided to a backside of the tub 21 to generate a rotational magnetic force, a rotor rotated by the stator, and a rotating shaft connected to the rotor to rotate the drum. Hence, the drive unit can rotate the drum 22 in direct.

Meanwhile, a detergent supply unit (not shown) can be installed at the cabinet 1 so as to be pushed in or pulled out like drawer. A power button 16 is provided to the cabinet 1 to turn on/off a power of the laundry treating apparatus.

The door 8 is rotatably joined to the cabinet 1 to open/close the opening 13.

The door 8 is provided to the front side of the cabinet 1 and joined to the cabinet 1 rotatably, thereby attracting user's attention. Moreover, as a user should grip the door 8 in order to insert or discharge laundry through the opening 13, the door 8 may be a part most easily accessible by the user.

Hence, a control panel 860 may be provided to the door 8 so as to display a state of the laundry treating apparatus or the laundry receiving part 20 and/or receive an input of an operation or control command for executing at least one of a wash cycle and a dry cycle.

Namely, the control panel 860 may include a display panel 861 displaying a state of the laundry receiving part 20.

The display panel 861 displays (outputs) information processed by the laundry treating apparatus. For example, the display panel 861 can display a running screen information of a cycle (e.g., wash cycle, dewater cycle, dry cycle, etc.) driven in the laundry treating apparatus or UE/GUI (user interface/graphic user interface) information corresponding to the running screen information.

The control panel 860 may include a control panel 862 receiving an input of a control command for executing a wash cycle or a dry cycle in the laundry reeving part 20.

The control panel 862 may be formed of PCB and the like. The control panel 862 may include a panel configured to transceiver signals remotely by having a communication module of WiFi and the like.

And, the control panel 862 may play a role as a control unit configured to control a wash or dry cycle to be performed in the laundry receiving unit 20 by converting the inputted control command into a launch signal.

The control panel 862 is provided separately from a controller (not shown) controlling a drive unit, a water supply unit, a drain unit and is able to play a role as an auxiliary controller configured to control the display panel 861 only. Thus, although a power is not supplied to the controller (not shown), the control panel 860 can be supplied with power only so as to control the display panel 861 and the control panel 862.

Hence, the control panel 862 plays a role as an auxiliary controller controlling the configuration provided to the door 8, whereby standby power can be reduced considerably.

Meanwhile, the display panel 861 may be provided with a touch panel or a touchscreen. A power may be configured to be turned on/off through a touch input to the display panel 861. Here, if the power of the laundry treating apparatus is controlled through the display panel 861, the power button 16 can be omitted.

The door 8 may have a diameter greater than that of the opening 13. And, a center of the door 8 may be set to incline toward a top or front side rather than a center of the opening 13.

Thus, since the control panel 860 is provided within the door 8, a user can easily recognize and access the control panel 860.

Hence, the front panel 10 having the opening 13 may include a stepped surface 14 for holding an outer circumference of the door 8 and a holding surface 15 extending from the stepped surface to the opening 13 so as to come in contact with the backside of the door 8.

Namely, the stepped surface 14 is bent inward from the front panel 10 so as to hold the door 8 together with the holding surface 15.

Therefore, the door 8 may be externally exposed from the front panel 10 in part and have a big diameter to facilitate the control panel 860 to be exposed to a user.

The front panel 10 may include a plane part 11 having the opening 13 and an incline part 12 extending from a top side of the plane part 11 to incline upward. And, a portion of the opening 13 may be formed at a bottom end of the incline part 12.

Namely, the plane part 11 may be provided vertical to a ground surface. And, the incline part 12 may be provided to gradually incline toward a backside of the front panel 10 from the top side of the plane part 11 to a top end.

And, an incline corresponding to the incline part 12 may be provided to a top side of the door 8. Namely, the door 8 may have the incline provided to get thinner toward the top side.

Thus, as the control panel 860 is provided to the top side of the door 8 so as to improve user's accessibility. And, a user taller than the cabinet 1 can easily recognize the control panel 860.

See-through holes 811 and 821 may be included within the door 8 so that a user can see through the opening 13.

The see-through holes 811 and 821 are formed of transparent material, whereby an inside of the laundry receiving part 20 can be seen through the opening 13.

The see-through holes 811 and 821 may be provided below the control panel 860.

Figure 3:
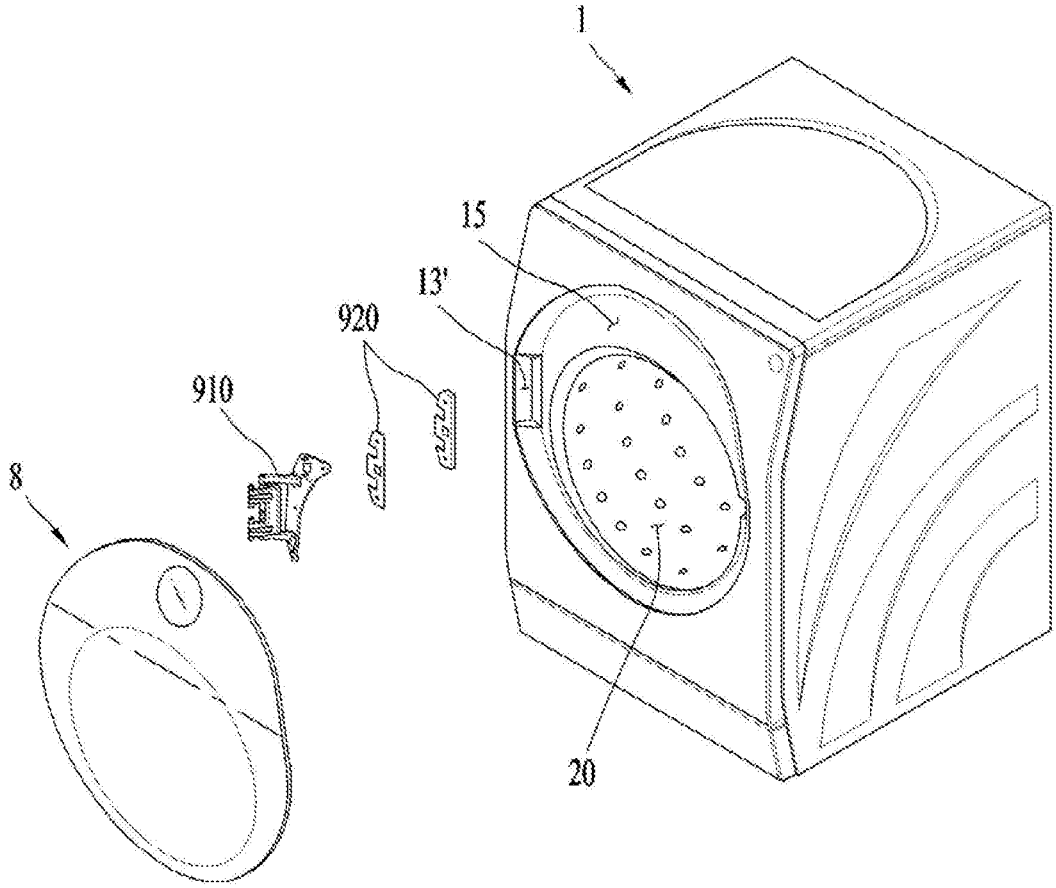
FIG. 3 is an exploded perspective diagram of a door of a laundry treating apparatus according to the present invention.

FIG. 3 sows one example of a hinge part 900 for rotatably joining the door 8 to the cabinet 1.

The hinge part 900 may include a base 910 joined to each of the door 8 and the cabinet 1 to turn the door 8 and a hinge holder 920 joining to fix the base 910 to the door 8 or cabinet 1.

In case that a plurality of hinge holders 920 are provided, one hinge holder may be joined to the door 8 together with the base 910 and another hinge holder may be joined together with the base 910 by being inserted in an opening perforated hole 13' provided to one side of the opening 13 of the cabinet 1.

Namely, the hinge holder 920 may assist the base 910 to be joined to the door 8 or cabinet 1 and play a role in supporting the base 910.

Figure 4:
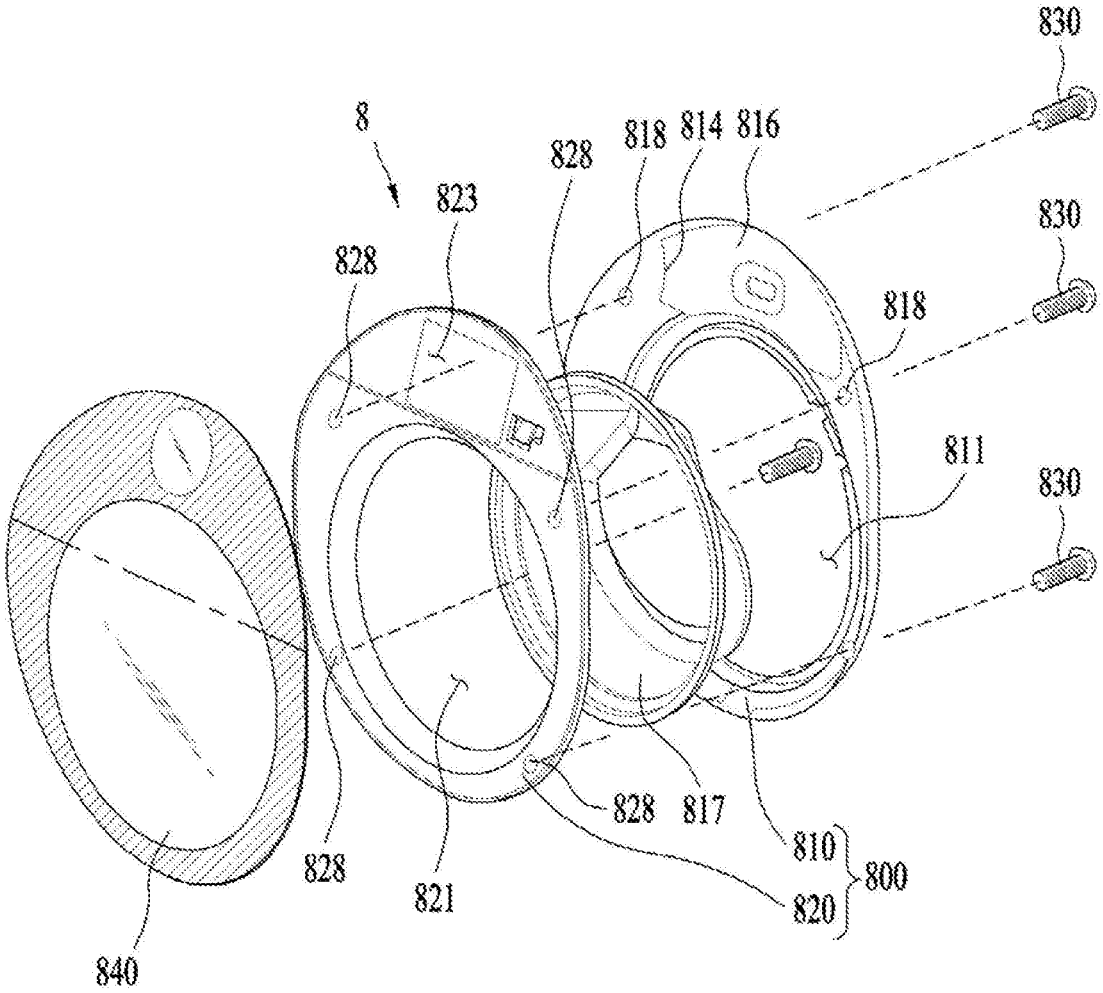
FIG. 4 is a diagram showing a door assembly structure of a laundry treating apparatus according to the present invention.

FIG. 4 is a diagram shows components of the door 8 and one example of assembling the components into the door 8.

The door 8 may include a first frame 810 opening/closing the opening 13, a second frame 820 joined to a front side of the first frame 810, and a door cover 840 joined to a front side of the second frame 820 to form a front side of the door 8.

Thus, the door 8 is configured with a plurality of frames instead of a single body in order to install the components such as the control panel 860, a control line, the hinge part 900 and the like by forming a space inside.

The first frame 810 and the second frame 820 can form an exterior of the door 8, and more particularly, a front side and a rear side of the door 8, respectively.

The first frame 810 may include a first see-through hole 811 perforating the first frame 810 to enable an inside of the laundry receiving part 20 to be seen through, a panel input hole 814 provided to enable the control panel 860 860 to be inserted, and a panel cover 816 provided in parallel with a backside of the first frame 810 by opening/closing the panel input hole 814.

A gasket 817 may be provided to an inner circumference of the first see-through hole 811 to seal the opening 13. If the door 8 closes the opening 13, the gasket 817 seals the opening 13 by being inserted in the inner circumference of the opening 13 and is able to guide laundry or water, which moves to the opening 13 within the laundry receiving part 20, to the inside of the laundry receiving part 20 again.

The gasket 817 is formed of transparent material so that the inside of the laundry receiving part 20 can be externally exposed through the opening 13.

The second frame 820 may include a second see-through hole 821 provided to a portion corresponding to the first see-through hole 811 by perforating the second frame 820 and a panel display hole 823 provided to expose the control panel 860 externally.

The door cover 840 may be attached to the front side of the second frame 820 through an adhesive agent or the like and formed of transparent material overall.

Meanwhile, portions corresponding to the panel display hole and the second see-through hole 821 may be formed of transparent material and the rest of portions may be tinted I black to raise aesthetic impression by cutting off the inner configuration.

The first frame 810 and the second frame 820 may be jointed to each other by a fastening member 830. The fastening member 830 penetrates the backside of the first fame 810 and is then able to be joined to the second frame 820. Thus, as the door cover 840 can be provided in a manner of being attached to the second frame 820, the interference between the door cover 840 and the fastening member 830 can be prevented.

The first frame 810 may further include a join hole 818 formed in an inner circumference of the first frame 810 so that the fastening member 830 is inserted in the join hole 818 to be joined by penetrating the first frame 810. And, the second frame 820 may have a join part 828 provided to the backside of the second frame 820 to be joined to the fastening member 830.

The fastening member 830 is joined to the join part (not shown) provided to the second frame 820 by penetrating the join hole 818, thereby enabling the first and second frames 820 and 810 to be strongly joined to each other.

Regarding the door 8 having the above structure, after the first frame 810 and the second frame 820 have been joined together by an adhesive agent and the like without employing the fastening member 830, the second frame 820 and the door cover 840 can be joined together by an adhesive agent and the like. Yet, since there is a waiting time until adhesion is completed after coating the adhesive agent, a process for manufacturing the door 8 may be delayed. Hence, it may be preferable to join the first and second frames 810 and 820 together quickly through the fastening member 830.

FIG. 5A shows a backside of the door 8, and FIGS. 5B to 5D show the structure that the hinge part 900 enables the door 8 to swing.

Referring to FIG. 5A, the hinge part 900 is seated on the backside of the second frame 820 and the first frame 810 is joined to the backside of the second frame 820, whereby the hinge part 900 can be fixed to the door 8.

Referring to FIGS. 5B to 5D, the hinge part 900 may include a base 910 joined to a lateral side of the opening, projection portions 912 and 913 projected from the base 910 to be rotatably joined to the second frame 820, and a hinge holder 920 joined to the backside of the second frame 820 to support the projection portions 912 and 913 rotatably.

The hinge holder 920 can include a steel sheet capable of supporting the projection portions 912 and 913 stably despite that the projection portions 912 and 913 are repeatedly rotated. Namely, if the second frame 820 is formed of material such as plastics, the hinge holder 920 can reinforce the rigidity of the second frame 820.

The hinge holder 920 and the projection portions 912 and 913 are joined between the first frame 810 and the second frame 820, whereby locations can be fixed thereto.

Referring now to FIG. 5A, although the first frame is firmly joined to the second frame 820 by the fastening member 830, a weld line may be formed due to a presence of the join hole 818.

Namely, in the course of manufacturing the first frame 810 by injection molding, the weld line can be formed due to differences of speed and direction of injection in forming the join hole 818.

The weld line may ruin the sense of beauty and degrade the overall unity. A user may mistakenly think that a crack is formed in the door 8, thereby misunderstanding a quality of the laundry treating apparatus.

In case that the first and second frames 810 and 820 form the whole exterior of the door 8, the unity of the door 8 may be weakened. And, it is possible that the door cover 840 attached to the front side of the second frame 820 may be detached from the second frame 820 by the vibration generated from the laundry receiving part 20.

Moreover, as a gap is generated between the joined first and second frame 810 and 820, installation locations of the control panel 860, the hinge part 900 and the like located inside may be changed.

Hence, it is necessary to prevent the join hole 818 from being externally exposed as well as to reinforce the joined state between the first and second frames 810 and 820.

Meanwhile, referring to FIG. 5D, since the hinge holder 920 and the projection portions 912 and 913 are provided between the first and second frames 810 and 820, whenever the door 8 is opened/closed, an external force for separating the first and second frames 810 and 820 from each other may be generated.

If the door 8 fully opens the opening 13, the projection portions 912 and 913 may come into contact with an outer circumference of the second frame 820.

If the second frame 820 comes into contact with the projection portions 912 and 913, an angle of excessively rotating the door 8 may be limited but the second frame 820 may be broken or damaged.

Hence, it is necessary to limit the excessive rotation of the door 8 and to prevent the breakage of the components of the door 8 including the second frame 820.

Figure 6A:
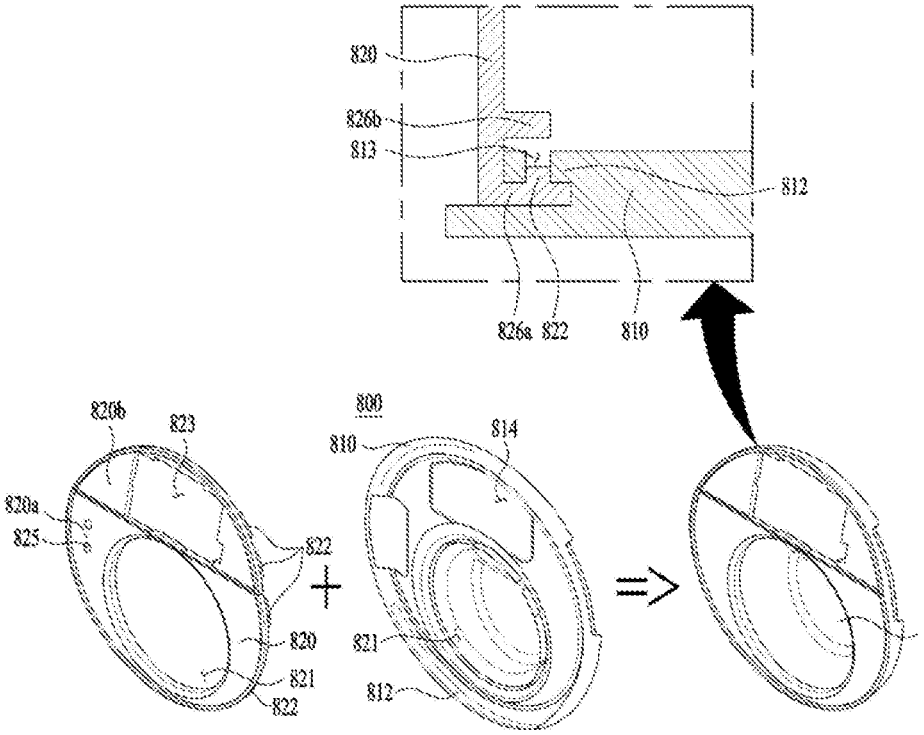
FIGS. 6A and 6B are diagrams showing a door of a laundry treating apparatus according to another embodiment of the present invention.
Figure 6B:
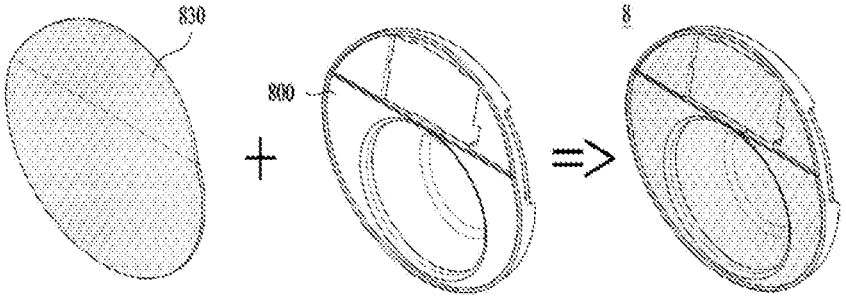

FIGS. 6A and 6B show an embodiment of maintaining and reinforcing the unity and aesthetic impression of the exterior by improving the joining force of the door 8.

Referring to FIG. 6A, the door 8 may include a first frame 810 opening/closing the opening and a second frame 820 joined by being received within the first frame 810.

Namely, the first and second frames 810 and 820 can be joined together in a manner that an outer circumference of the second frame 820 is inserted in an inner circumference of the first frame 810. The second frame 820 is exposed to the front side of the door only but the lateral side and backside of the door 8 may be formed by the first frame 810.

Thus, since the door frame 810 and 820 can derive the same effect as integrally formed into a single body, unity and identity can be improved. Moreover, since the second frame 820 is joined by being received in the first frame 810, it is able to prevent the first and second frames 810 and 820 from being separated from each other. Therefore, the installation locations of the hinge part 900 and the control panel 860 joined or located within the door 8 can be fixed.

Here, the second frame 820 includes at least one join hook 822 formed by being projected along an inner circumference of the second frame 820 and the first frame 810 may include a hook join portion 813 formed on an inner circumference of the first frame 810 to be joined to the join hook 822.

Optionally, a plurality of the hooks 822 and a plurality of the hook join portions 813 may be provided in a manner of being spaced apart from each other in a predetermined distance.

Thus, as the first and second frames 810 and 820 are joined together firmly and physically, it is able to prevent the first and second frames 810 and 820 from being separated from each other. Moreover, since the second frame 820 is joined to the first frame 810 in a manner of being completely received in the first frame 810, the first frame 810 forms an exterior of the door 8 except a front side of the door 8. Hence, the unity and aesthetic impression can be improved.

In this case, as the fastening member 830 for joining the first and second frames 810 and 820 together can be omitted, a manufacturing process can be simplified. And, as the join hole 818 is omitted, it is able to prevent the weld line from being generated from the door 8.

Meanwhile, the first frame 810 may include a join rib 812 provided along an inner circumference of the first frame by being spaced apart from the inner circumference in a predetermined distance, and the second frame 820 may include a contact portion 826 projected from an inner circumference of the second frame to come into contact with the join rib 812.

The join rib 812 may be provided in a manner of being projected from the inner circumference of the first frame 810, and the second frame 820 may play a role in limiting a length for the second frame 820 to be inserted in the inner circumference of the first frame 810. Particularly, the join rib 812 may be provided in a manner of being spaced apart from the inner circumference of the first frame 810 into the first frame 810 by a thickness of the first frame 810 or more.

Thus, the second frame 820 can be inserted until coming into contact with the join rib 812 and the outer circumference of the second frame 820 may not be externally exposed from the door 8.

An adhesive agent may be coated between the join rib 812 and the contact portion 826. If so, as the join rib 812 and the contact portion 826 are attached to each other though the adhesive agent, the first and second frames 810 and 820 can be joined together.

In this case, as the fastening member 830 for joining the first and second frames 810 and 820 together can be omitted, a manufacturing process can be simplified. And, as the join hole 818 is omitted, it is able to prevent the weld line from being generated from the door 8.

Meanwhile, the join rib 812 may be provided in a manner of being spaced apart from the inner circumference of the first frame 810 in a predetermined distance toward a center direction of the first frame, and the contact portion 826 of the second frame 820 may include a rib coming into contact with both an inner size and an outer side of the join rib 812.

Preferably, the join rib 812 is provided in a manner of being spaced apart from the inner circumference of the first frame 810 by the thickness of the rib provided to the contact portion 826.

The contact portion 826 may include a first contact rib 826*a* coming into contact with an outer side of the join rib 812 and a second contact rib 826*b* coming into contact with an inner side of the join rib 812.

Namely, the first and second contact ribs 826*a* and 826*b* may form a shape of a recess in which the join rib 812 is inserted and received.

Hence, if an adhesive agent is coated between the first and second contact ribs 826*a* and 826*b*, it can be easily coated on the join rib 812.

At least one join hook 822 projected from one of the first and second contact ribs 826*a* and 826*b* is provided to one of the first and second contact ribs 826*a* and 826*b*, and a hook join portion 813 joined to the join hook may be included in the join rib 812.

The hook join portion 813 may include a hole perforating a portion of the join rib 812 or a recess provided to one side of the join rib 812 to receive the join hook 822 therein.

Thus, the first and second frames 810 and 820 can be firmly joined together by the physical hook join as well as by the adhesive agent. Of course, the use of the adhesive agent may be omitted.

Therefore, the second frame 820 can be stably received within the first frame 810.

Meanwhile, as described above, the front panel 10 can be configured in a manner that one side of the front panel 10 inclines. Namely, if the front panel 10 includes the incline part 12, a top side of the second frame 820 may have an incline corresponding to the incline part 12.

Namely, the top side of the second frame 820 may be provided to incline toward the first frame 810.

The second frame 820 may include a frame body 820*a* provided in parallel with the first frame 810 and a body incline part 820*b* provided to the top side of the frame body by inclining toward the first frame 810.

Here, the number of the join hooks 822 provided to the connected portion between the frame body 820*a* and the body incline part 820*b* may be greater than the number of the join hooks 822 provided to the frame body 820*a* or the body incline part 820*b*.

Namely, if the incline changed portion in the second frame 820 is joined to the first frame 810, the joining force is weakened.

Therefore, if more join hooks 822 are provided to the connected portion than provided to the rest of portions, although an incline angle of the second frame 820 is changed, the joining force can be maintained.

Meanwhile, the join rib 812 may be provided in a manner of being spaced apart from the outer circumference of the first frame 810 into the first frame 810 by a length amounting to a sum of the thickness of the second frame 820 and the thickness of the door cover 840.

This is to enable the door cover 840 to be joined to the frame 810 by being received therein.

Referring to FIG. 6B, an outer circumference of the second frame 820 and an outer circumference of the door cover 840 can be provided in a manner of being received in an inner circumference of the first frame 810.

The door cover 840 can be provided in a manner of being joined to a front side of the second frame 820 and then received in the first frame 820. Thus, although vibration is transferred to the door 8, it is able to prevent the door cover 840 from being separated from the first frame 810. Moreover, since the outer circumference of the door cover 840 is not exposed to the first frame 810, the unity of the door 8 can be improved.

The door cover 840 may be joined in a manner of being attached to the inner circumference of the second frame 820 through an adhesive agent and the like.

Yet, as described above, if the second frame 820 is provided by being received in the first frame 810, the first frame 810 forms an exterior of the door 8. Hence, the projection portions 912 and 913 of the hinge part 900 may be limitedly provided between the first frame 810 and the second frame 820.

Hence, the first frame 810 may further include a hinge input hole 815 provided to one side or backside of the first frame 810 so as to be penetrated by the hinge part 900 [cf. FIG. 6(*a*)]. Particularly, the hinge input hole 815 can form a space in which the projection portions 912 and 913 of the hinge part 900 can be freely rotated by being exposed.

Moreover, the hinge part 900 may further include a hinge cover 930 covering the hinge input hole 815.

Figure 7A:
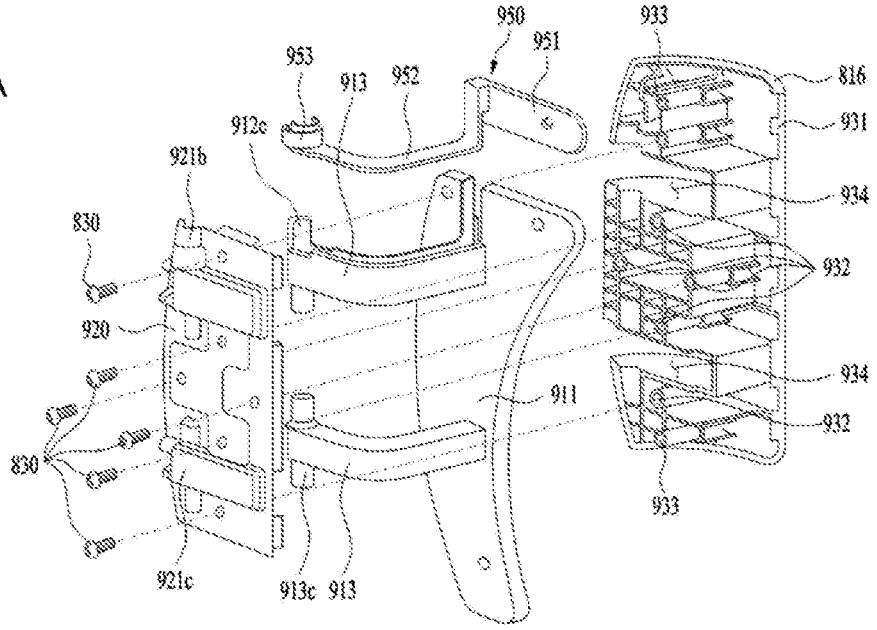
FIGS. 7A and 7B are diagrams showing a configuration of a hinge part of a laundry treating apparatus according to the present invention.
Figure 7B:
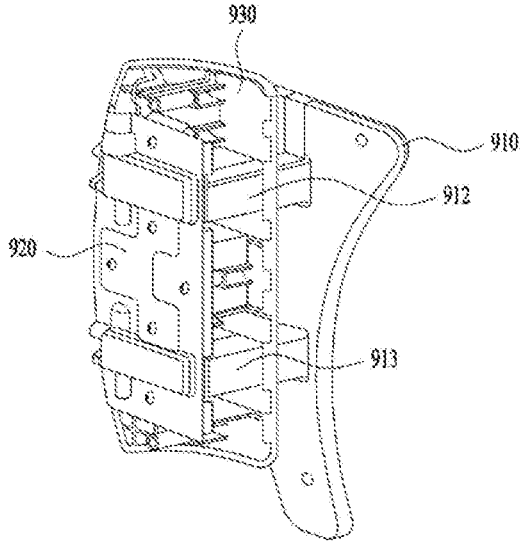

FIGS. 7A and 7B show that the hinge part 900 forms a module type hinge assembly with the hinge holder 920 and the hinge cover 930.

Referring to FIG. 7A, the hinge cover 930 can be joined to the hinge holder 920 by the fastening member 830.

Particularly, the hinge holder 920 is seated on the backside of the second frame 820, and the hinge cover 930 can be seated on the backside of the second frame 820 as well. Thereafter, a plurality of the fastening members 830 penetrate the second frame 810 and the hinge holder 920 and can be then joined to the hinge cover 930.

Thus, by the single fastening member 830, the second frame 810, the hinge holder 920 and the hinge cover 930 can be joined together. In doing so, the base 910 can be joined in a manner that the projection portions 912 and 913 are pressed to the hinge holder 920 and the hinge cover 930.

Meanwhile, the fastening member 830 can be inserted in the join hole 825 formed by perforating one side of the second frame 820 [cf. FIG. 6A]. Namely, the fastening member 830 penetrates the front side of the door instead of the backside of the door 8. Since the join hole 825 is blocked by the door cover 840, a portion to which the fastening member 830 is joined may not be externally exposed. Hence, even if a weld line is formed in the join hole 825, since the weld line is not externally exposed, the unity and aesthetic impression of the door 8 can be improved.

Referring now to FIG. 7A and FIG. 7B, the hinge part 900 may include the base 910 joined to the cabinet, the projection portions 912 and 913 projected from the base 910 to be connected to the door, the hinge holder 920 joined to the door to support one sides of the projection portions 912 and 913 rotatably, and the hinge cover 930 joined to the hinge holder 920 to support the other sides of the projection portions rotatably.

The hinge cover 930 may include a cover body 931 forming a main body of the hinge cover by being provided in parallel with one side of the first frame 810, a holder joint portion 932 provided to a front side of the cover body 931 to be joined together with the hinge holder 920 by the fastening member 830, a frame join portion 933 joined together with the second frame 820 by the fastening member 830, and an indirect cut portion 934 provided by cutting or penetrating a prescribed portion of the cover body 931 to enable the projection portions 912 and 913 to rotate freely.

Meanwhile, the hinge part 900 of the laundry treating apparatus of the present invention needs to guide a harness or wire for delivering control signals to the controller (not shown) or the drive unit (not shown) provided within the cabinet 1.

Hence, the hinge part 900 may further include a harness connecting portion 950 provided above or below the base 910.

The harness connecting portion 950 and the base 910 can be assembled or joined into a single body.

The harness connecting portion 950 may include a harness body 951 provided in parallel with the base 910 by being joined to the base 910, a harness projection portion 952 provided in parallel with the projection portion 912, and a harness shaft 953 forming the shaft of the door 8 by being provided to an end of the harness projection portion 952.

Meanwhile, the projection portions may include shafts 912*c* and 913*c* provided to ends by extending to for the rotation shaft of the door. The hinge holder 920 may include a holder body 921 in a plate shape and shaft receiving recesses 921*b* and 922*c* provided to one side of the holder body 921 concavely to receive the shafts therein.

The shaft receiving recesses 921*b* and 922*b* are the areas on which most of load works when the door 8 is turned. Moreover, when the door 8 is turned, torsion stress applies to the holder body 921. Hence, the holder body 921 may get bent.

To prevent this, in the hinge holder 920, front sides or backsides of the shaft receiving recesses 921*b* and 922*b* or a portion of the holder body 921 on which the stress works strongly can be formed thicker than the rest portion.

Yet, if the hinge holder 920 is formed thick, a larger space is necessary to enable the hinge holder 920 to be received between the first frame 810 and the second frame 820. Moreover, if a specific portion of the hinge holder 920 is formed thick, it is difficult to mold and process the hinge holder 920 to manufacture. And, the material cost is raised disadvantageously.

Therefore, it is necessary to reinforce the rigidity of the hinge holder 920 while maintaining uniform thickness of the hinge holder 920.

Figure 8:
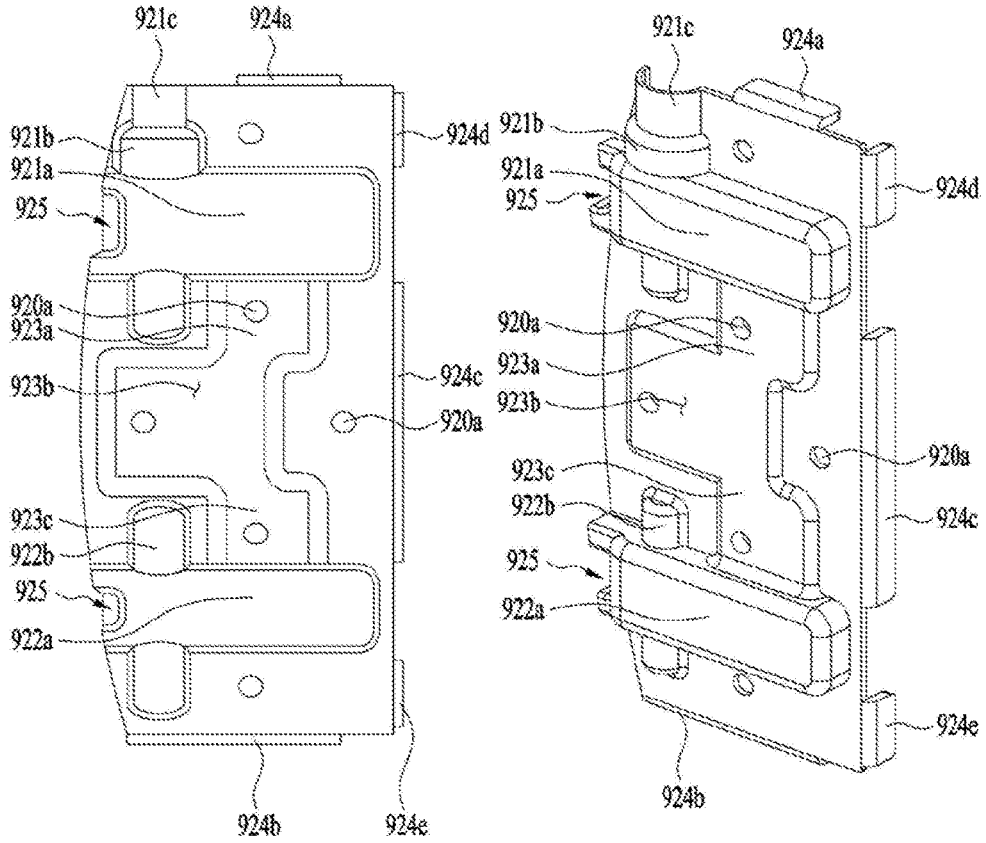
FIG. 8 is a diagram showing a configuration of a hinge holder of a laundry treating apparatus according to the present invention.

The structure of the hinge holder 920 of one embodiment of the present invention is described with reference to FIGS. 7A, 7B and FIG. 8 as follows.

The hinge holder 920 of the laundry treating apparatus according to the present invention can be provided in uniform thickness.

Namely, any portion of the hinge holder 920 of the laundry treating apparatus according to the present invention can have the uniform thickness.

The hinge holder 920 may further include a reinforce recess 923 provided to one side of the shaft receiving recess 921*b*/922*b* in a manner that one side of the holder body is formed concave.

Since the reinforce recess 923 includes a recess concavely provided to one side of the holder body 921, it is able to prevent the holder body 921 from being bent or crooked.

The reinforce recess 923 may be provided in a manner of being stepped and projected from one side of the holder body 921, and a depth of the reinforce recess 923 may be uniform.

The reinforce recess 923 prevents the holder body 921 from being twisted and also plays a role in maintaining and reinforcing rigidity of the hinge holder 920 together with the shaft receiving recesses 921*b* and 922*b*.

The projection portion may include a first projection portion 912 projected from the base 910 by including a first shaft 912*c* provided to an end in a manner of extending to form the rotation shaft of the door and a second projection portion 913 projected from the base 910 by being spaced apart from the first projection portion 912 in a predetermined distance and including a second shaft 913*c* provided to an end in parallel with the first shaft 912*c*.

Here, the hinge holder 920 may include a first shaft receiving recess 921*b* having at least one portion of the first shaft 912*c* received therein and a second shaft receiving recess 922*b* having at least one portion of the second shaft 913*c* received therein by being spaced apart from the first shaft receiving recess 921*b* in a predetermined distance.

The reinforce recess 923 may be provided between the first and second shaft receiving recesses 921*b* and 922*b* of the holder body 921.

The reinforce recess 923 and the first and second shaft receiving recesses 921*b* and 922*b* may be provided in a manner of being projected from the hinge holder 920 in the same direction.

Here, a depth of each of the first and second shaft receiving recesses 921*b* and 922*b* may be set different from that of the reinforce recess 923.

Thus, if a depth of each of the first and second shaft receiving recesses 921*b* and 922*b* is set different from that of the reinforce recess 923, it is advantageous in distributing the stress applied to the holder body 921.

Particularly, the first projection portion 912 may include a first projection rib 912*a* projected from the base 910 toward the door 8 and a first receiving rib 912*b* extending from the first projection rib 912*a* in a direction getting away from the opening by having the first shaft 912*c* provided to an end. And, the second projection portion 913 may include a second projection rib 913*a* projected from the base 910 toward the door 8 and a second receiving rib 913*b* extending from the second projection rib 913*a* in a direction getting away from the opening by having the second shaft 913*c* provided to an end.

To correspond to the above structure, the hinge holder 920 may include a first receiving rib receiving recess 921*a* provided to one side of the first shaft receiving recess 921*b* having the first shaft 912*c* received therein so as to receive at least one portion of the first receiving rib therein and a second receiving rib receiving recess 922*a* provided to one side of the second shaft receiving portion so as to receive at least one portion of the second receiving rib therein.

Namely, the first and second receiving rib receiving recesses 921*a* and 922*a* are provided to one side and the other side of the holder body 921, respectively and can reinforce the rigidity and torsion stress durability of the hinge holder 920 together with the reinforce recess 923.

Meanwhile, a depth of each of the first and second receiving rib receiving recesses 921*a* and 922*a* can be set different from that of the reinforce recess 932. This is to distribute the stress applied to the hinge holder 920 or the holder body 921 in various directions.

In this case, the depth of each of the first and second receiving rib receiving recesses 921*a* and 922*a* can be set equal to that of each of the first and second shaft receiving recesses 921*b* and 922*b*.

The reinforce recess 923 may include a center recess 923*b* provided between the first and second shaft receiving recesses 921*b* and 922*b*, a first extension recess 923*a* extending from one side of the center recess 923*b* toward the first receiving rib recess 921*a*, and a second extension recess 923*c* extending from the other side of the center recess toward the second receiving rib recess 922*a*.

The center recess 923*b* and the first and second extension recesses 923*a* and 923*c* may have the same step depth but differ from each other in size.

The center recess 923*b* may be provided in a manner of further extending from an overlapping portion between the first and second extension recesses 923*a* and 923*c* in one direction, and each of the first and second extension recesses 923*a* and 923*c* may be provided in a manner of further extending from a portion overlapping with the center recess in the other direction.

Namely, the center recess 923*b* may be disposed in a manner of crossing with the first and second extension recesses 923*a* and 923*c*. Particularly, the center recess 923*b* may be provided in a manner of extending from the hinge holder 920 in an outer direction of the front panel 10, and the first and second extension recesses 923*a* and 923*c* may be provided in a manner of extending in an inner direction of the front panel 1.

Thus, since the shaft receiving recess 921*a*/922*a* is formed longer than the receiving rib receiving recess 921*b*/922*b*, it can be supplemented and reinforced.

The first and second extension recesses 923*a* and 923*c* may be provided in a manner of coming into contact with the first and second receiving rib receiving recesses 921*a* and 922*a*, respectively.

Meanwhile, the hinge holder 920 includes a flange 924 extending from an outer circumference of the holder body, and the flange 924 may be bent in a direction opposite to a depth direction of the reinforce recess 923.

The flange 924 may include a center flange 924*c* provided to a portion facing the opening in an outer circumference of the holder body 921 by extending by a gap between the first and second receiving rib receiving recesses 921*a* and 922*a*, a first extension flange 924*d* extending to one end of the holder body by being spaced apart from the center flange 924*c* by a thickness of the first receiving rib receiving recess, a second extension flange 924*d'* extending to the other end of the holder body by being spaced apart from the center flange 924*c* by a thickness of the second receiving rib receiving recess, a top flange 924*a* provided to one side of the outer circumference of the holder body in a direction vertical to a direction facing the opening, and a bottom flange 924*b* provided to the other side.

The flange 924 is projected from the outer circumference of the holder body 921, thereby maximizing the effect of reinforcing the rigidity and torsional durability of the hinge holder 920. And, the flange 924 can improve the durability against an external force for bending the holder body 921.

Preferably, the recesses provided to the holder body 921 are projected from one side of the holder body 921 in the same direction by differing from each other in depth only.

This is to support the configuration of the base 910 stably and minimize a defect rate and error in forming each recess by press molding.

Thus, as the hinge holder 920 of one embodiment of the present invention has uniform thickness and various recesses and flanges by pressing or bending the holder body 921, it is able to maintain or improve durability and rigidity better than those of a hinge holder having a specific portion formed thicker.

Since the hinge holder 920 is formed in uniform thickness, it is able to lower a defect rate and product cost in manufacturing the hinge holder 920.

Meanwhile, the hinge holder 920 may further include a stop portion 925 provided to prevent the projection portion 912/913 from colliding with the first frame 810 or the second frame 820 despite the opening 13 fully opened/closed by the door 8 and limit a rotation angle of the door 8.

Regarding the projection portions 912 and 913, the receiving rib 912*b* or 913*b* may come into contact with the first frame 810 or the second frame 820. Hence, the hinge holder 920 can include the stop portion 925 for limiting the rotation angles of the receiving ribs 912*b* and 913*b*.

Figure 9A:
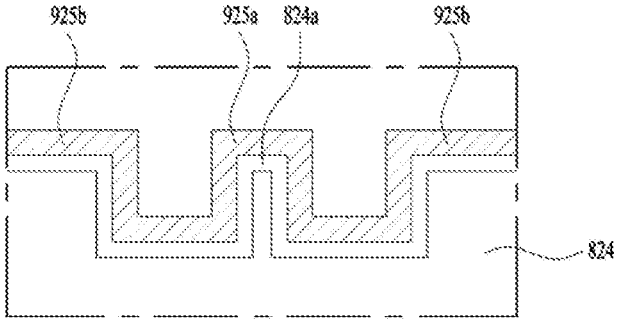
FIGS. 9A and 9B are diagrams showing a configuration of a stop part of a laundry treating apparatus according to the present invention.
Figure 9B:
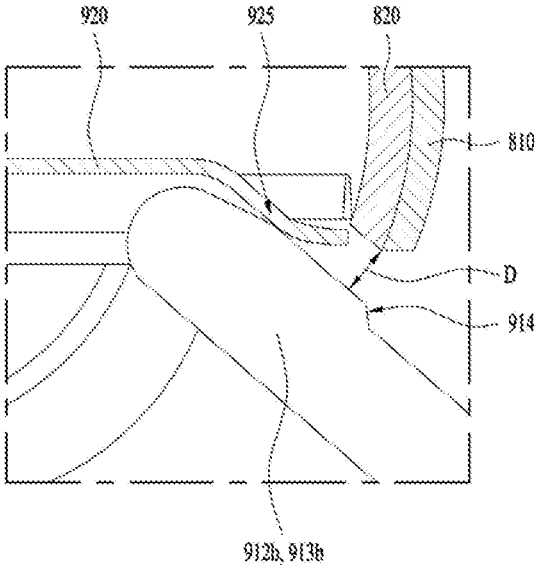

FIG. 9A is a cross-sectional diagram of the stop portion 925 in front view, and FIG. 9B is a cross-sectional diagram of the stop portion 925 in lateral view.

The stop portion 925 may include a support portion 925*a* provided to come into contact with the receiving rib 912*b*/913*b* by being projected in a direction opposite to a direction in which the shaft receiving recess 921*b*/922*b* is projected from the holder body 921 or concavely provided thereto.

The support portion 925*a* may be provided in a manner of being projected in a direction opposite to a direction in which the receiving ribs 912*b* and 913*b*, the reinforce recess 923 and the like are projected from the holder body 921. If the first and second receiving ribs 912*b* and 913*b* are rotated in the hinge holder 920, they will come into contact with the hinge holder 920 on a surface opposite to a projected opposite side of the reinforce recess 923.

Meanwhile, the stop portion 925 may further include a rigid bending portion 925*b* projected from both lateral sides of the support portion 925*a* in a direction of the shaft receiving recess.

The rigid bending portion 925*b* is provided to cross with the support portion 925*a*, thereby enabling the stop portion 925 to maintain rigidity and shape overall.

Meanwhile, the stop portion 925 may be provided to the shaft receiving recess 921*b*/922*b* in a direction opposite to the receiving rib receiving recess 921*a*/922*a* or provided to one end of the hinge holder 920.

Namely, if the door 8 fully opens the opening 13, the receiving ribs are rotated centering on the shaft receiving recesses 921*b* and 922*b*, thereby getting away from the receiving rib receiving recesses 92*a* and 922*a*.

The second frame 810 may further include a holder seating part 824 provided to the backside having the join part 825 formed therein in order for the hinge holder 920 to be seated thereon. The holder seating part 824 is provided to correspond to a shape of the hinge holder 920, thereby coming into contact with the holder body 921 of the hinge holder 920. Moreover, the holder seating part 824 may further include a frame projection portion 824*a* provided along a shape of the stop portion 925 to support the support portion 925*a* and the rigid bending portion 925*b*.

Referring to FIG. 9B, the receiving rib 912*b*/913*b* may include a block portion 14 provided to one side of the shaft 912*c*/913*c* to come into contract with the stop portion 925.

The block portion 14 may be configured to preferentially come into contact with the stop portion 925.

Thus, the receiving rib 912*b*/913*b* can be configured to be always spaced apart from the first frame 810 in a predetermined distance D. The block portion 14 can beforehand prevent the possibility that the receiving rib 912*b*/913*b* collides with the first frame 810.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An apparatus for treating laundry, comprising:

a cabinet having an opening;

a laundry receiving part provided within the cabinet and configured to receive laundry therein, the laundry receiving part having an input entrance communicating with the opening;

a door configured to open and close the opening; and a hinge part that rotatably couples the door to the cabinet, the hinge part comprising:

a base coupled to the cabinet, a plurality of projection portions that extend from the base and that are rotatably connected to the door, a hinge holder coupled to the door and configured to rotatably support the plurality of projection portions, and a hinge cover coupled to the hinge holder and configured to support the plurality of projection portions, wherein the hinge holder comprises:

a holder body having a plate shape, a plurality of shaft receiving recesses projected from one surface of the holder body and configured to support the plurality of projection portions, and a reinforce recess projected from the one surface of the holder body and defined between the plurality of shaft receiving recesses, wherein the plurality of projection portions comprise:

a plurality of projection ribs that extend from the base, and a plurality of receiving ribs that extend from the projection ribs in a direction away from the opening, the receiving ribs comprising shafts disposed at ends of the receiving ribs, and wherein the hinge holder further comprises a stop portion that is disposed at an outer periphery of the shaft receiving recesses, that is recessed from the one surface of the holder body in a direction opposite to the shaft receiving recesses, and that is configured to limit a rotation angle of the receiving ribs.

2. The apparatus of claim 1, wherein the reinforce recess and the shaft receiving recesses are projected from the one surface of the holder body in a same direction.

3. The apparatus of claim 1, wherein the plurality of projection portions comprise:

a first projection portion extending from the base and having a distal end rotatably coupled to the door; and a second projection portion extending from the base, the second projection portion being spaced apart from the first projection portion and rotatably coupled to the door, wherein the shafts comprise:

a first shaft provided at an end of the first projection portion and configured to define a rotation axis of the door, and a second shaft provided at an end of the second projection portion in parallel with the first shaft, and wherein the plurality of shaft receiving recesses comprise:

a first shaft receiving recess configured to receive at least one portion of the first shaft, and a second shaft receiving recess configured to receive at least one portion of the second shaft and spaced apart from the first shaft receiving recess in a reference distance.

4. The apparatus of claim 3, wherein the reinforce recess is provided between the first and second shaft receiving recesses of the holder body.

5. The apparatus of claim 4, wherein a depth of each of the first and second shaft receiving recesses is set different from a depth of the reinforce recess.

6. The apparatus of claim 5, wherein the first projection portion comprises a first projection rib extended from the base toward the door and a first receiving rib extending from the first projection rib in a direction getting away from the opening by having the first shaft provided to an end, wherein the second projection portion comprises a second projection rib extended from the base toward the door and a second receiving rib extending from the second projection rib in a direction getting away from the opening by having the second shaft provided to an end, and wherein the hinge holder comprises a first receiving rib receiving recess provided to one side of the first shaft receiving recess so as to receive at least one portion of the first receiving rib therein and a second receiving rib receiving recess provided to one side of the second shaft receiving portion so as to receive at least one portion of the second receiving rib therein.

7. The apparatus of claim 6, wherein a depth of each of the first and second receiving rib receiving recesses is set different from the depth of the reinforce recess.

8. The apparatus of claim 6, wherein the reinforce recess comprises:

a center recess provided between the first and second shaft receiving recesses;

a first extension recess extending from one side of the center recess toward the first receiving rib recess; and a second extension recess extending from the other side of the center recess toward the second receiving rib recess.

9. The apparatus of claim 8, wherein the center recess further extends from an overlapping portion between the first and second extension recesses in one direction and wherein each of the first and second extension recesses further extends from a portion overlapping with the center recess in the other direction.

10. The apparatus of claim 6, wherein the hinge holder comprises a flange extending from an outer circumference of the holder body and wherein the flange is bent in a direction opposite to a depth direction of the reinforce recess.

11. The apparatus of claim 10, wherein the flange comprises:

a center flange provided to a portion facing the opening in an outer circumference of the holder body by extending by a gap between the first and second receiving rib receiving recesses;

a first extension flange extending to one end of the holder body by being spaced apart from the center flange by a thickness of the first receiving rib receiving recess;

a second extension flange extending to the other end of the holder body by being spaced apart from the center flange by a thickness of the second receiving rib receiving recess;

a top flange provided to one side of the outer circumference of the holder body in a direction vertical to a direction facing the opening; and a bottom flange provided to the other side.

12. The apparatus of claim 1, wherein the stop portion comprises a support portion projected in the direction opposite to the shaft receiving recesses, the support portion being configured to come into contact with one of the receiving ribs.

13. The apparatus of claim 12, wherein the stop portion further comprises a bending portion projected from lateral sides of the support portion in a direction of the shaft receiving recesses.

14. The apparatus of claim 1, wherein the receiving ribs comprise a block portion disposed at a side of one of the receiving ribs and configured to come into contact with the stop portion.

15. The apparatus of claim 1, wherein the plurality of shaft receiving recesses, the reinforce recess, and the stop portion are portions defined in the hinge holder.

16. The apparatus of claim 15, wherein the plurality of shaft receiving recesses, the reinforce recess, and the stop portion are defined by press molding of the holder body.

* * * * *